US009941083B2

(12) United States Patent
Matsuyama et al.

(10) Patent No.: US 9,941,083 B2
(45) Date of Patent: Apr. 10, 2018

(54) PRESSURE SWITCH

(71) Applicant: Kabushiki Kaisha Saginomiya Seisakusho, Tokyo (JP)

(72) Inventors: Kenichi Matsuyama, Tokorozawa (JP); Satoshi Miyakawa, Tokorozawa (JP); Yoshihiro Hamabe, Sayama (JP)

(73) Assignee: Kabushiki Kaisha Saginomiya Seisakusho, Tokyo (JP)

( * ) Notice: Subject to any disclaimer, the term of this patent is extended or adjusted under 35 U.S.C. 154(b) by 0 days.

(21) Appl. No.: 14/932,779

(22) Filed: Nov. 4, 2015

(65) Prior Publication Data

US 2016/0133408 A1 May 12, 2016

(30) Foreign Application Priority Data

Nov. 7, 2014 (JP) ..... 2014-227033

(51) Int. Cl.
*H01H 35/34* (2006.01)
*H01H 1/06* (2006.01)
*H01H 1/14* (2006.01)

(52) U.S. Cl.
CPC ..... *H01H 35/34* (2013.01); *H01H 1/06* (2013.01); *H01H 35/343* (2013.01); *H01H 35/346* (2013.01); *H01H 2001/145* (2013.01)

(58) Field of Classification Search
CPC ..... H01H 35/26; H01H 35/34; H01H 13/48; H01H 13/702; H01H 33/666; H01H 2033/6623; H01H 35/346; H01H 35/2614
USPC ..... 200/83 R, 83 J, 81 R, 82 R, 275, 341, 200/279, 8 R
See application file for complete search history.

(56) References Cited

U.S. PATENT DOCUMENTS 5,004,876 A 4/1991 Sogge et al.
5,216,213 A * 6/1993 Sato ..... H01H 9/047 200/302.1
2004/0000466 A1* 1/2004 Kubat ..... H01H 25/041 200/6 A

FOREIGN PATENT DOCUMENTS

CN 102686326 9/2012
JP S53-113379 U 2/1952
JP H02-220320 9/1990
JP H08-235952 9/1996
(Continued)

OTHER PUBLICATIONS

201510701908.X, Apr. 1, 2017, Chinese Office Action.
(Continued)

*Primary Examiner* — Ahmed Saeed
(74) *Attorney, Agent, or Firm* — Workman Nydegger

(57) ABSTRACT

A pressure switch is disclosed. The pressure switch includes a housing and a pressure-receiving chamber that communicates with a duct to which an operating pressure is supplied. The pressure switch also includes a diaphragm assembly with a diaphragm that is displaced in response to a pressure inside the pressure-receiving chamber. The pressure switch also includes a movable contact that comes into contact with a fixed contact accommodated in a center portion of an inside of the housing when the pressure inside the pressure-receiving chamber is above a certain value. One of the movable contact and the fixed contact has radially diverging contact faces that are arranged such that contact between the fixed contact and the moveable contact can be established with at least two of the radially diverging contact faces at the same time.

5 Claims, 12 Drawing Sheets

(56) References Cited

FOREIGN PATENT DOCUMENTS

| | | |
|---|---|---|
| JP | H10-134681 | 5/1998 |
| JP | 2000-322963 | 11/2000 |
| JP | 2002-279875 | 9/2002 |

OTHER PUBLICATIONS

Partial English translation of Japanese patent document No. JPS53-113379 (U), published Feb. 14, 1952 (p. 6, line 18 to p. 7, line 5).

* cited by examiner

PRESSURE SWITCH

CROSS-REFERENCES TO RELATED APPLICATIONS

This application claims the benefit of Japanese Patent Application No. 2014-227033, filed Nov. 7, 2014, which is hereby incorporated by reference herein in its entirety.

BACKGROUND OF THE INVENTION

1. Field of the Invention

The present invention relates to a pressure switch including a diaphragm.

2. Description of the Related Art

An air-conditioning system or the like generally includes a pressure switch which is provided to piping and configured to detect a pressure of a coolant, carbon dioxide gas, and the like in the piping and to send a detection output. As disclosed in Japanese Patent Laid-Open No. 2002-279875, such a pressure switch includes: a casing assembly connected to a coolant passage via one end of a joint pipe; a diaphragm laminate which partitions off a pressure sensing chamber as a pressure-receiving chamber in the casing assembly; and a rod capable of bringing a movable contact and a fixed contact that are located in the casing assembly close to or away from each other in response to a displacement of the diaphragm laminate. In the above-described configuration, grid-like multipoint contacts are formed on an upper face of the fixed contact which is opposed to the movable contact. Accordingly, if a foreign substance such as a fiber or a contaminant is caught between the fixed contact and the movable contact, the foreign substance is pushed into a recess between the multipoint contacts. Thus, continuity between the fixed contact and the movable contact is secured whereby occurrence of a continuity defect is avoided.

In addition, as disclosed in Japanese Patent Laid-Open No. H10-134681(1998), for example, there is also proposed a pressure switch which is deprived of an actuating force transmission member such as the aforementioned actuating pin and is provided with a curved diaphragm in place of the above-described movable contact. Here, a central part of the curved diaphragm is made invertible so that the diaphragm can come into contact with or move away from a fixed contact. This diaphragm is held by a pressing portion of an insulator member to be fitted into a recess of a body, such that the curved portion of the diaphragm is opposed to the fixed contact.

SUMMARY OF THE INVENTION

In the case of the pressure switch described in Japanese Patent Laid-Open No. H10-134681(1998), a peak of the curved portion of the inverted diaphragm comes into contact with the fixed contact at a single point. Accordingly, this pressure switch is at a risk of causing instability of electrical connection between the diaphragm and the fixed contact if a foreign substance is caught between the peak of the curved portion of the inverted diaphragm and the fixed contact. Moreover, when the peak of the curved portion of the inverted diaphragm is in contact with the fixed contact at the single point, if the peak of the curved portion of the inverted diaphragm comes into contact in a state where a position of the peak of the curved portion of the diaphragm is biased with respect to a flat face of the fixed contact due to a manufacturing error, the position of the peak of the curved portion of the diaphragm does not establish a stable contact position. As a consequence, the pressure switch is also at a risk of increasing contact resistance and damaging continuity reliability.

In view of the above-described problem, the present invention aims to provide a pressure switch. The pressure switch can reliably establish electrical connection between a diaphragm and a fixed contact even when a foreign substance is caught between a peak of a curved portion of the inverted diaphragm and the fixed contact, and also set a contact position of the peak of the curved portion of the diaphragm with the fixed contact to a stable contact position that does not lead to an increase in contact resistance.

To achieve the above described object, a pressure switch according to the present invention comprises: a housing to accommodate a connection terminal having a fixed contact into an inside of the housing; a pressure-receiving chamber communicating with a duct to which an operating pressure is supplied; and a diaphragm assembly having a diaphragm configured to be displaced in response to a pressure inside the pressure-receiving chamber and provided with a movable contact to come into contact with the fixed contact when the pressure inside the pressure-receiving chamber is equal to or above a predetermined value, in which at least one of the movable contact formed on the diaphragm and the fixed contact has a plurality of radially diverging contact faces.

In addition, a contact face of the movable contact of the diaphragm may be formed into an annular shape, and a contact face of the fixed contact may be formed substantially into a cross shape. Alternatively, a contact face of the movable contact of the diaphragm may be formed into an annular shape, and a contact face of the fixed contact may be formed substantially into a Y-shaped.

Moreover, a contact face of the movable contact of the diaphragm may be formed substantially into a cross shape, and a contact face of the fixed contact may be formed into an annular shape. Alternatively, a contact face of the movable contact of the diaphragm may be formed substantially into a Y-shaped, and a contact face of the fixed contact may be formed into an annular shape.

According to the pressure switch of the present invention, at least one of the movable contact formed integrally with the diaphragm and the fixed contact includes a plurality of radially diverging contact faces whereby the contact faces of the movable contact and the fixed contact come into the contact with each other at a plurality of positions with equal pressures. As a consequence, the pressure switch can reliably establish electrical connection between the diaphragm and the fixed contact even when a foreign substance is caught between a peak of a curved portion of the inverted diaphragm and the fixed contact, and also set a contact position of the peak of the curved portion of the diaphragm with the fixed contact to a stable contact position that does not lead to an increase in contact resistance.

Further features of the present invention will become apparent from the following description of exemplary embodiments (with reference to the attached drawings).

DESCRIPTION OF THE EMBODIMENTS

Figure 1:
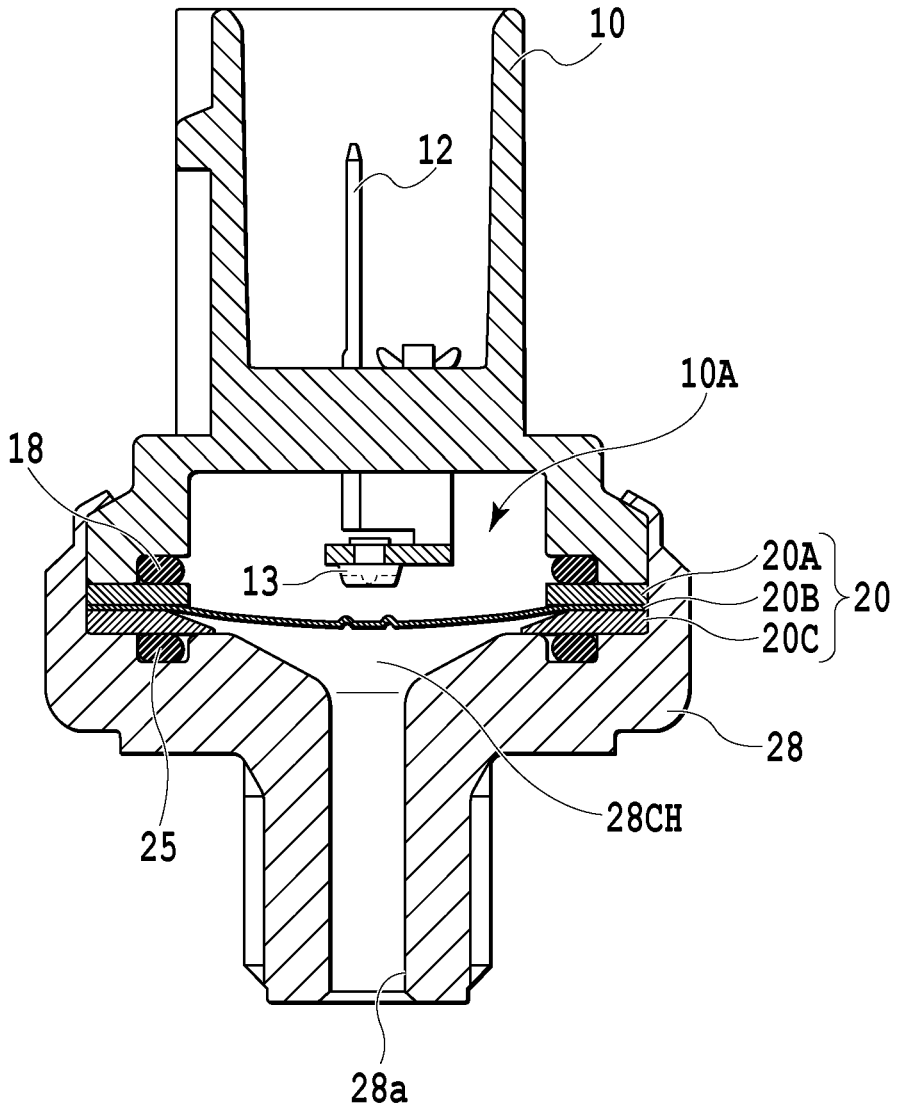
FIG. 1 is a cross-sectional view showing a configuration of an example of a pressure switch according to the present invention.

FIG. 1 shows substantial part of a pressure switch according to the present invention.

The pressure switch is attached, for example, to a not-illustrated hydraulic device or piping to supply air, a coolant, water, or the like via a connection joint 28.

As shown in FIG. 1, the pressure switch is a normally-open switch. The pressure switch includes, as its main constituents: a diaphragm assembly 20 joined to an end of the connection joint 28; a casing 10 connected to the connection joint 28 and incorporating a connection terminal 12 to be described later; and a fixed contact 13 of the connection terminal 12 provided inside the casing 10 and made capable of coming into contact with and being separated from a movable contact 20*br* of a diaphragm 20B to be described later in response to a displacement of the diaphragm 20B.

Figure 4:
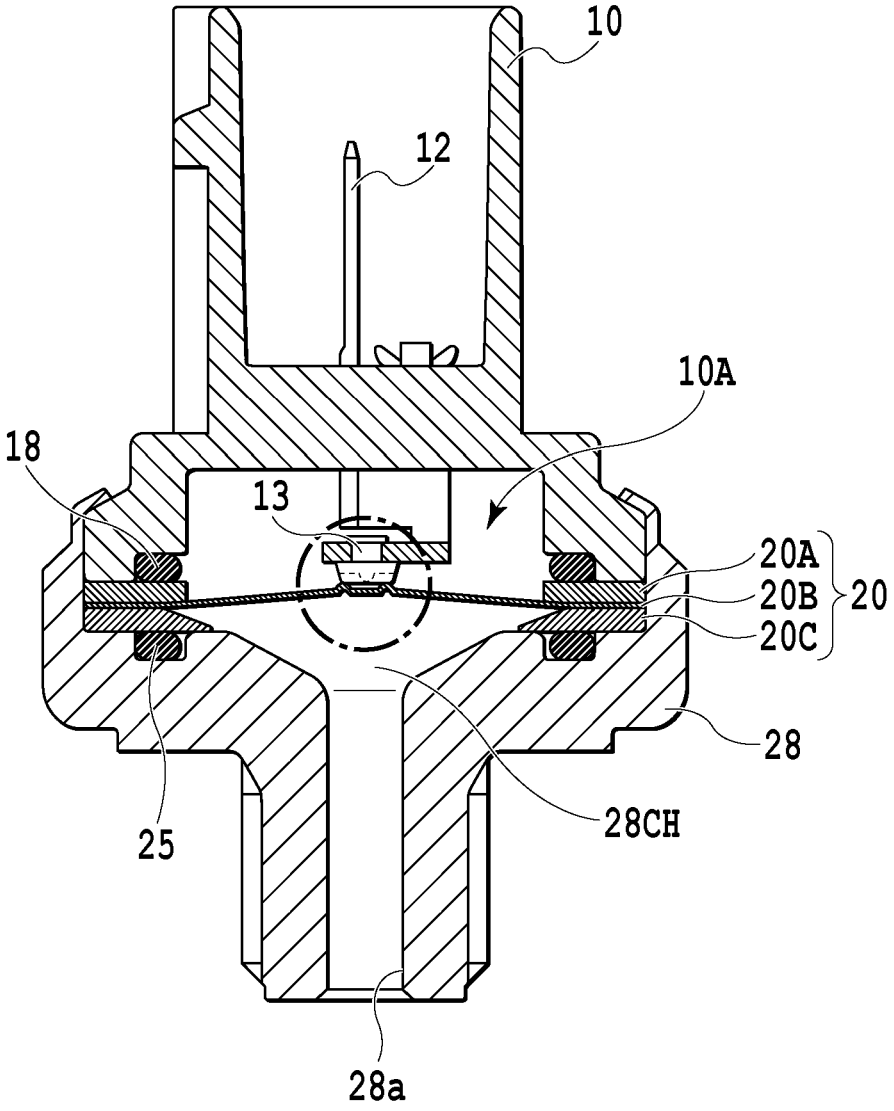
FIG. 4 is a cross-sectional view made available for explaining an operation in the example shown in FIG. 1.

The casing 10 as a housing is formed by using a resin material, for example, and is provided with a recess 10A located on inside of the casing 10 and designed to house the fixed contact 13 of the connection terminal 12. An external connection part of the connection terminal 12 passes through a hole in the casing 10 and projects into a cavity which is formed on the outside. The external connection part of the connection terminal 12 is connected to a not-illustrated pressure detection circuit. Accordingly, when the movable contact 20*br* of the diaphragm 20B comes into contact with the fixed contact 13 as shown in FIG. 4 in response to inversion of the diaphragm 20B, a predetermined current is fed to the connection joint 28 via the diaphragm 20B. Thus, the pressure detection circuit detects that a pressure inside a pressure-receiving chamber to be described later reaches a predetermined pressure.

The diaphragm assembly 20 is disposed in such a way as to serve as a partition between a pressure-receiving chamber 28CH communicating with a flow passage 28*a* of the connection joint 28 and an open end portion of the casing 10. The diaphragm assembly 20 includes, as its main constituents: an upper plate 20A in contact with a peripheral edge of the open end portion of the casing 10 and with an O-ring 18; a lower plate 20C in contact with a peripheral edge of the pressure-receiving chamber 28CH of the connection joint 28 and with an O-ring 25; and the diaphragm 20B sandwiched between the upper plate 20A and the lower plate 20C opposed to each other.

The upper plate 20A is formed into an annular shape with a metal material, for example, and by press forming, cutting, die casting, forging, or the like.

The lower plate 20C is formed into an annular shape with a metal material, for example, and by press forming, cutting, die casting, forging, or the like. An annular groove into which the O-ring 25 is inserted is formed in the connection joint 28 at a peripheral edge of a hole of the lower plate 20C concentrically with the peripheral edge of the pressure-receiving chamber 28CH of the connection joint 28. The pressure-receiving chamber 28CH communicating with the flow passage 28*a* of the connection joint 28 is formed from a surface of the diaphragm 20B, an inner peripheral portion of the lower plate 20C, and an inner peripheral portion of the connection joint 28. Here, an outer peripheral edge of the diaphragm 20B is sandwiched between the upper plate 20A and the lower plate 20C.

The diaphragm assembly 20 is produced by integrating the upper plate 20A and the lower plate 20C together while sandwiching the diaphragm 20B in between, by welding and thus bonding outer peripheral edges thereof. Hereby, welded portions are formed on outer peripheral portions of the upper plate 20A and the lower plate 20C. It should be noted that if the pressure switch is used in a low-pressure environment, for instance, then the diaphragm assembly 20 does not always have to be bonded together by welding. Instead, the diaphragm assembly 20 may be formed only by fixation by swaging the connection joint 28, for example.

The diaphragm 20B is formed from a thin-plate metal material such as a stainless steel plate, which has corrosion resistance to the fluid supplied through the flow passage 28*a* in the connection joint 28, for example. Alternatively, the diaphragm 20B may be formed from a thin rolled steel plate and then subjected to plating with nickel or the like. This method reduces contact resistance of the diaphragm 20B, and improves corrosion resistance as well as abrasion resistance thereof.

Figure 5:
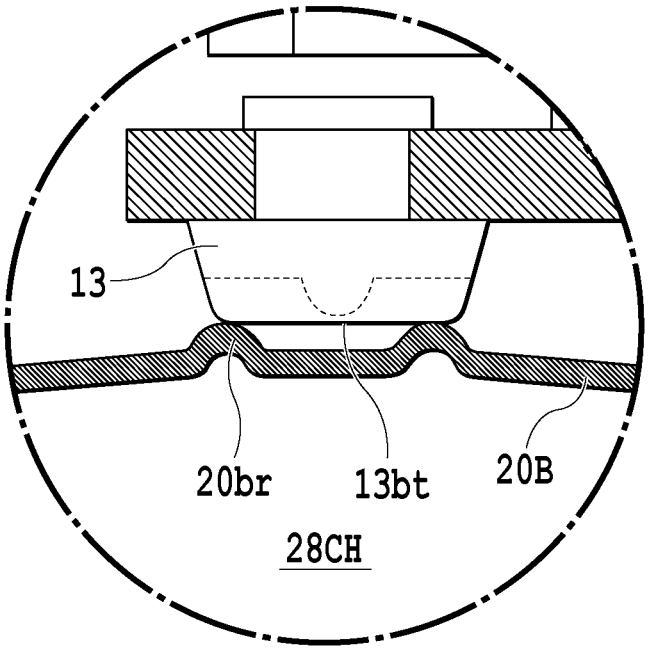
FIG. 5 is a partial enlarged view which shows part of a configuration shown in FIG. 4 under magnification.
Figure 6:
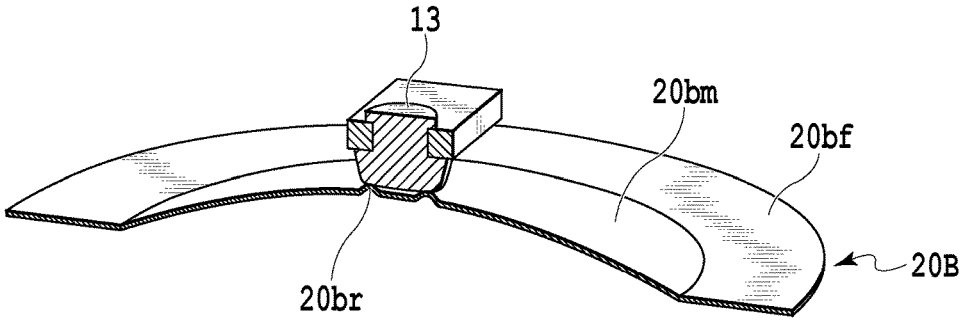
FIG. 6 is a perspective view including a cutaway view of a fixed contact and a diaphragm illustrated in FIG. 4.

As shown under magnification in FIG. 6, the diaphragm 20B includes: a flange portion 20*bf* to be sandwiched between the upper plate 20A and the lower plate 20C; and a movable portion 20*bm* which is invertible, i.e., elastically deformable. The contact 20*br* having an annular contact face is integrally formed by press work at a peak on a surface of the movable portion 20*bm* having a predetermined curvature radius and being opposed to the fixed contact 13. As partial enlarged in FIG. 5, the contact 20*br* projects upward by a predetermined height from the surface of the movable portion 20*bm* so as to come into contact with a cross-shaped contact face 13*bt* of the fixed contact 13 when the diaphragm 20B is inverted.

The term "inversion" used in this specification is intended to include a state where the form of the diaphragm 20B gradually changes from a flat state or a downward projecting state to an upward projecting state, and a state where the form of the diaphragm 20B rapidly changes from the flat state or the downward projecting state to the upward projecting state.

In the above-described example, the diaphragm assembly 20 includes the upper plate 20A, the lower plate 20C, and the diaphragm 20B. However, the present invention is not limited to this example. For instance, the diaphragm assembly may be formed from the upper plate 20A and the diaphragm 20B, or formed from the lower plate 20C and the diaphragm 20B. Alternatively, instead of providing the diaphragm assembly 20, only the diaphragm 20B may be sandwiched between the casing 10 and the connection joint 28 directly through the O-rings.

Figure 2A:
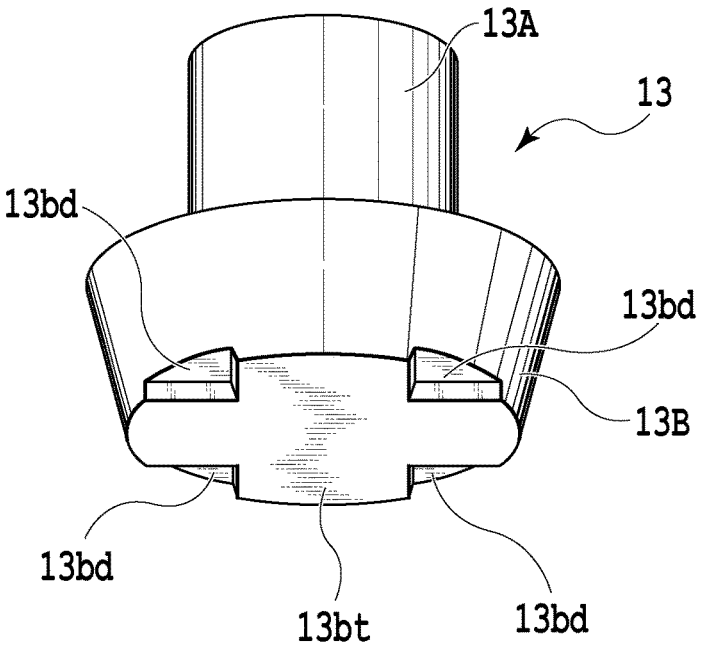
FIG. 2A is a perspective view showing external appearance of an example of a fixed contact used in the example shown in FIG. 1.
Figure 3:
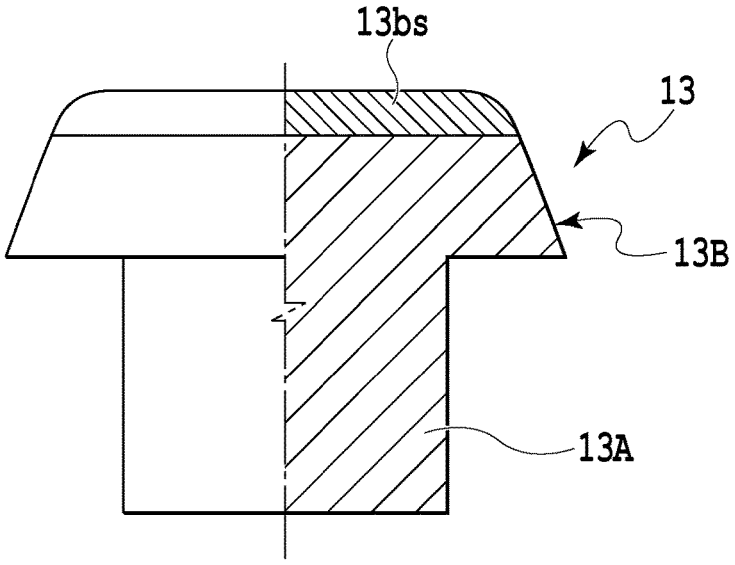
FIG. 3 is a cross-sectional view showing a structure of the fixed contact shown in FIG. 2A.

As shown enlarged in FIG. 2A, the fixed contact 13 is made of copper-based metal or iron-based metal, for example, and includes a columnar portion 13A to be joined to a lower end of the connection terminal 12, and a contact portion 13B of a truncated cone shape integrally formed at a lower end of the columnar portion 13A. As shown in FIG. 3, a coating layer 13*bs* of a noble metal such as gold and silver having a predetermined film thickness is formed on a surface of the contact portion 13B.

As shown enlarged in FIG. 2A, an end surface of the contact portion 13B includes the substantially cross-shaped contact face 13*bt* formed from portions radially diverging at intervals of 90°. Cavities 13*bd* are formed at four positions around the contact face 13*bt* which is a flat end surface of the contact portion 13B. Note that the contact face 13*bt* at the end surface of the contact portion 13B is not limited to this example. For instance, as shown in FIG. 2B, a contact face 14*bt* formed from a convex arc surface having a predetermined curvature radius may be provided instead.

Figure 2B:
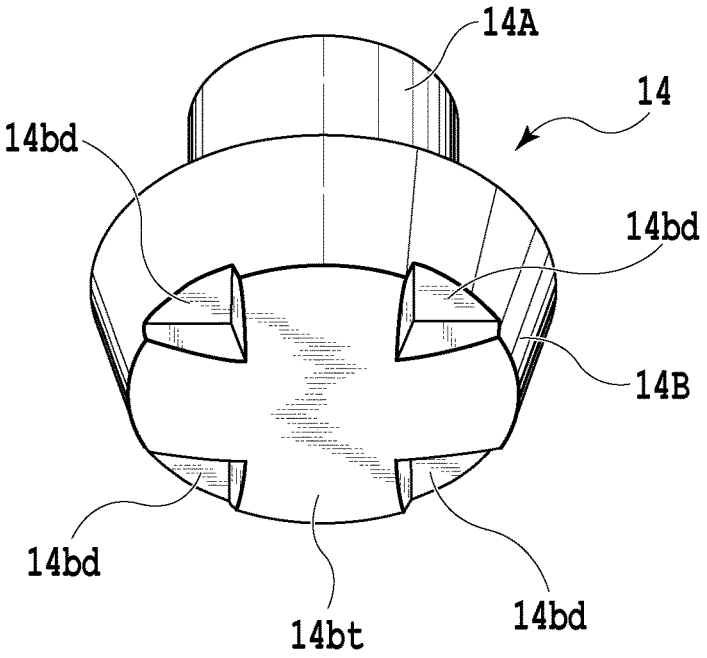
FIG. 2B is a perspective view showing external appearance of variations of the example shown in FIG. 2A.

In FIG. 2B, a fixed contact 14 having the contact face 14*bt* is made of copper-based metal or iron-based metal, for example, and includes a columnar portion 14A to be joined to the lower end of the connection terminal 12, and a contact portion 14B of a truncated cone shape integrally formed at a lower end of the columnar portion 14A. A coating layer of a noble metal such as gold and silver having a predetermined film thickness is formed on a surface of the contact portion 14B. As shown enlarged in FIG. 2B, an end surface of the contact portion 14B includes a substantially cross-shaped contact face 14*bt* formed from portions radially diverging at intervals of 90°. Cavities 14*bd* are formed at four positions around the contact face 14*bt*, which is the convex arc surface of the contact portion 14B.

Figure 7:
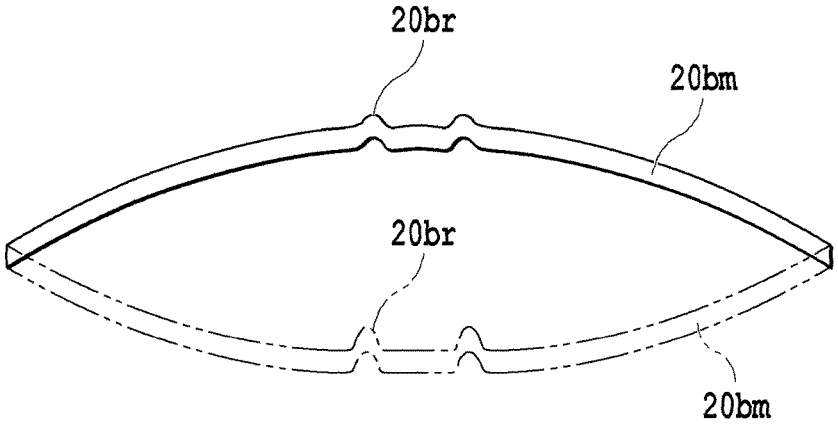
FIG. 7 is a view made available for explaining an operation of the diaphragm.
Figure 8:
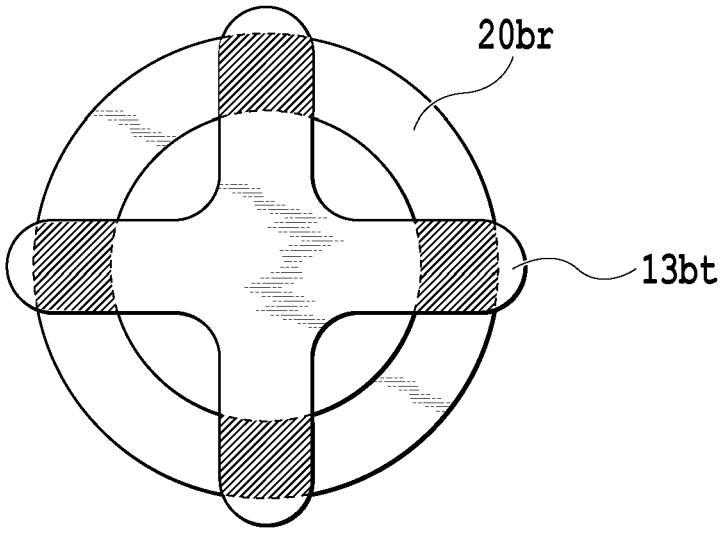
FIG. 8 is a diagram showing a relative position of the fixed contact to a movable contact of the diaphragm.

Thus, as shown in FIG. 7, when the diaphragm 20B is inverted from a state indicated with chain double-dashed lines to a state indicated with solid lines, the cross-shaped contact face 13*bt* of the fixed contact 13 comes into contact with the annular contact 20*br* at four positions as shown in FIG. 8. Accordingly, since the contact face 13*bt* comes into contact with the annular contact 20*br* at the four positions, it is possible to achieve reliable electrical connection between the diaphragm 20B and the fixed contact 13 in case a foreign substance is caught between the peak of the inverted diaphragm 20B and part of the fixed contact 13. In other words, if the foreign substance is caught at one of the positions, the electric connection can be achieved by the rest of the positions. This is due to the fact that, even when one of contact points of the contact 20*br* is disconnected by catching the foreign substance, the rest of the contact points are pressed against the fixed contact 13 due to flexure of the diaphragm and are thus kept from detachment.

In addition, the cross-shaped contact face 13*bt* comes into contact with the annular contact 20*br* at the four positions with equal pressures as shown in FIG. 8. As a consequence, an impact at the time of the inversion of the diaphragm 20B is dispersed.

In the above-described configuration, when a pressure inside the pressure-receiving chamber 28CH is below a predetermined value, as shown in FIG. 1, the contact 20*br* of the diaphragm 20B is located away from the cross-shaped contact face 13*bt* of the fixed contact 13. Accordingly, the above-mentioned pressure detection circuit detects that the pressure inside the pressure-receiving chamber 28CH is below the predetermined value since a given current is not fed to the connection joint 28 via the diaphragm 20B. On the other hand, when the pressure inside the pressure-receiving chamber 28CH is equal to or above the predetermined value, the contact 20*br* of the diaphragm 20B comes into contact with the cross-shaped contact face 13*bt* of the fixed contact 13. Accordingly, the above-mentioned pressure detection circuit detects that the pressure inside the pressure-receiving chamber 28CH is equal to or above the predetermined value since the given current is fed to the connection joint 28 via the diaphragm 20B.

In the above-described example, the end surface of the contact portion 13B of the fixed contact 13 has the cross-shaped contact face 13*bt*. However, the present invention is not limited to this example. For instance, as shown enlarged in FIG. 9A, an end surface 23B of a fixed contact 23 may have a substantially Y-shaped contact face 23*bt*.

The fixed contact 23 is made of copper-based metal or iron-based metal, for example, and includes a columnar portion 23A to be joined to the lower end of the connection terminal 12, and a contact portion 23B of a truncated cone shape integrally formed at a lower end of the columnar portion 23A.

The substantially Y-shaped contact face 23*bt* is formed from portions radially diverging at intervals of 120°, for example. Cavities 23*bd* are formed at three positions around the contact face 23*bt* which is a flat end surface of the contact portion 23B.

In this case, when the diaphragm 20B is inverted, the Y-shaped contact face 23*bt* of the fixed contact 23 comes into contact with the annular contact 20*br* at three positions. Note that the contact face 23*bt* at the end surface of the contact portion 23B is not limited to this example. For instance, as shown in FIG. 9B, a contact face 24*bt* formed from a convex arc surface having a predetermined curvature radius may be provided instead.

A fixed contact 24 having the contact face 24*bt* is made of copper-based metal or iron-based metal, for example, and includes a columnar portion 24A to be joined to the lower end of the connection terminal 12, and a contact portion 24B of a truncated cone shape integrally formed at a lower end of the columnar portion 24A.

The substantially Y-shaped contact face 24*bt* is formed from portions radially diverging at intervals of 120°, for example. Cavities 24*bd* are formed at three positions around the contact face 24*bt* which is the convex arc surface of the contact portion 24B.

In this case, when the diaphragm 20B is inverted, the Y-shaped contact face 24*bt* of the fixed contact 24 comes into contact with the annular movable contact 20*br* at three positions.

Figure 9A:
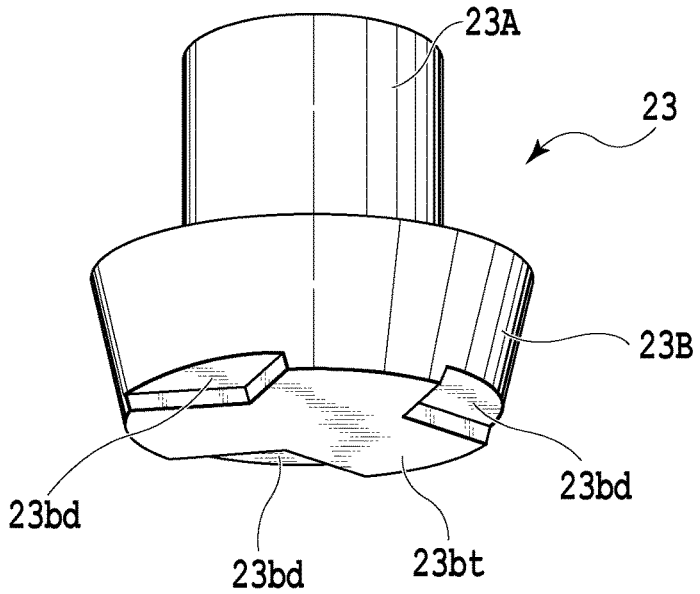
FIG. 9A is a perspective view showing external appearance of another example of the fixed contact used in the example shown in FIG. 1.
Figure 9B:
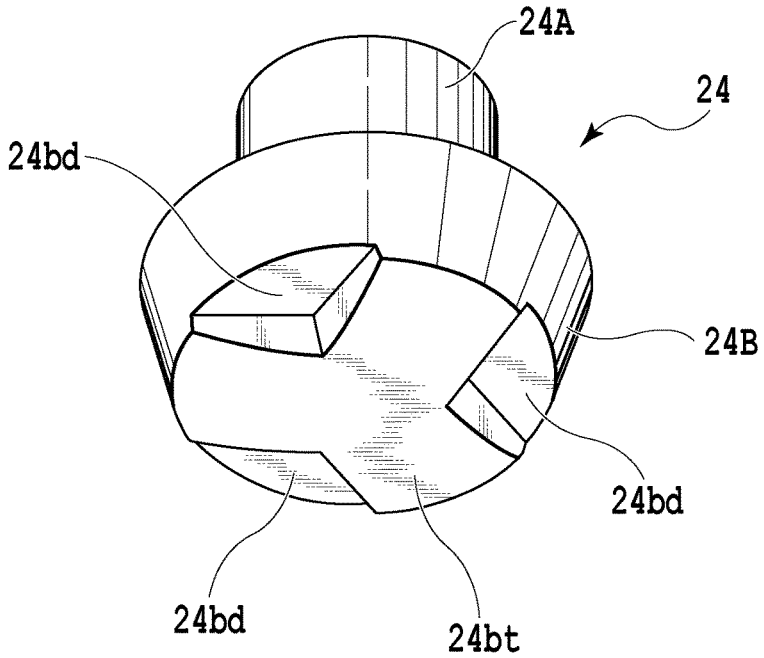
FIG. 9B is a perspective view showing external appearance of variations of the example shown in FIG. 9A.
Figure 10:
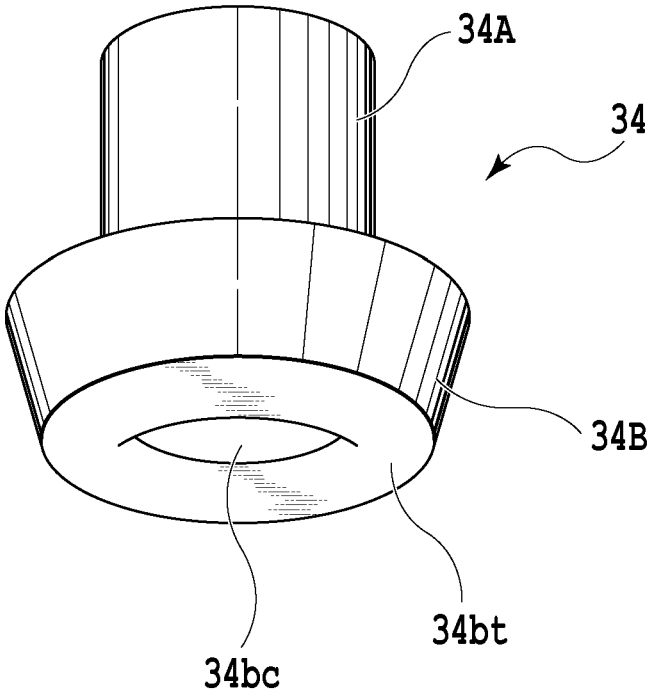
FIG. 10 is a perspective view showing external appearance of still another example of the fixed contact used in the example shown in FIG. 1.

Furthermore, the fixed contact is not limited to the examples shown in FIG. 2A and FIG. 9A. For instance, as shown enlarged in FIG. 10, a fixed contact 34 may be made of copper-based metal or iron-based metal, for example, and may include a columnar portion 34A to be joined to the lower end of the connection terminal 12, and a contact portion 34B of a truncated cone shape integrally formed at a lower end of the columnar portion 34A. A cavity 34*bc* is formed at a central part of an annular (donut-like) contact face 34*bt* at a flat end surface of the contact portion 34B. Here, the contact face 34*bt* at the end surface of the contact portion 34B is not limited to this example. For instance, the contact face 34*bt* may be formed from a convex arc surface having a predetermined curvature radius.

Figure 11:
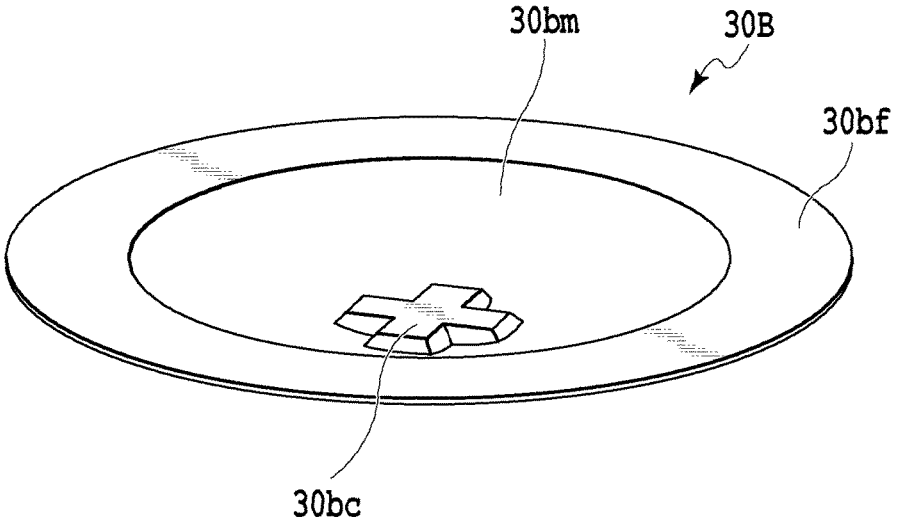
FIG. 11 is a perspective view showing another example of the diaphragm used in the example shown in FIG. 1.

In this case, as shown enlarged in FIG. 11, a diaphragm 30B to be coupled with the fixed contact 34 is formed from a flange portion 30*bf* to be sandwiched between the upper plate 20A and the lower plate 20C, and a movable portion 30*bm* which is invertible, i.e., elastically deformable. A cross-shaped contact 30*bc* is integrally formed by press work, for example, at a peak on a surface of the movable portion 30*bm*, which is formed to project toward the lower plate 20C, has a predetermined curvature radius, and is opposed to the fixed contact 34. The contact 30*bc* projects upward by a predetermined height from the surface of the movable portion 30*bm* so as to come into contact with the annular contact face 34*bt* of the fixed contact 34 when the diaphragm 30B is inverted. Note that the contact face of the contact 30*bc* is not limited to this example. For instance, the contact face may be formed as a concave arc surface having a predetermined curvature radius.

Figure 12:
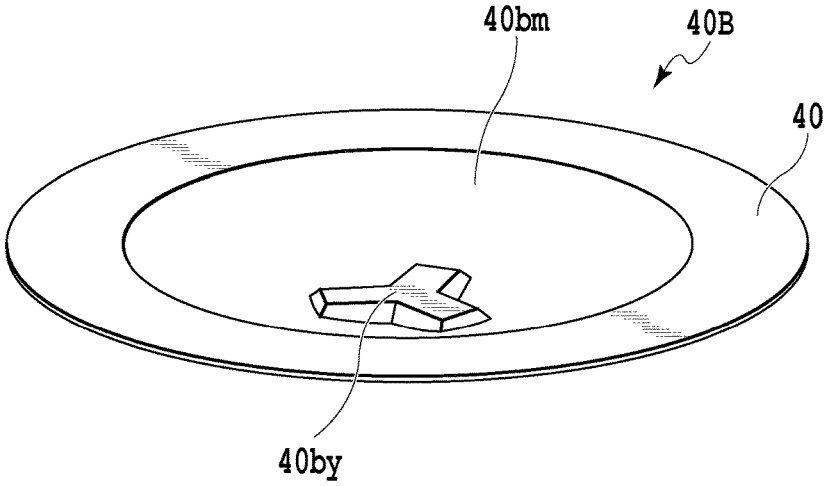
FIG. 12 is a perspective view showing yet another example of the diaphragm used in the example shown in FIG. 1.

In addition, a diaphragm 40B to be coupled with the fixed contact 34 is not limited to the above-described example. For instance, as shown in FIG. 12, the diaphragm 40B is formed from a flange portion 40*bf* to be sandwiched between the upper plate 20A and the lower plate 20C, and a movable portion 40*bm* which is invertible, i.e., elastically deformable. A Y-shaped contact 40*by* is integrally formed by press work at a peak on a surface of the movable portion 40*bm*, which is formed to project toward the lower plate 20C, has a predetermined curvature radius, and is opposed to the fixed contact 34. The contact 40*by* projects upward by a predetermined height from the surface of the movable portion 40*bm* so as to come into contact with the annular contact face 34*bt* of the fixed contact 34 when the diaphragm 40B is inverted. Note that the contact face of the contact 40*by* is not limited to this example. For instance, the contact face may be formed as a concave arc surface having a predetermined curvature radius.

The example of the pressure switch according to the present invention is applied to the normally-open switch. However, the present invention is not limited to this example and may naturally be applied to a normally-closed switch, for instance. Moreover, the diaphragm with the contact manufactured by an example of a method of manufacturing a diaphragm with a contact according to the present invention is applied to the pressure switch to be connected to the piping via the connection joint 28. However, the present invention is not limited to this example. For instance, the present invention may also be applied to a pressure switch disclosed in Japanese Patent Laid-Open No. H02-220320 (1990) or Japanese Patent No. 3031679. Furthermore, the contact of the diaphragm is formed integrally with the diaphragm in the above-described example. However, the present invention is not limited to this example. For instance, a configuration in which only a contact is joined to another portion is also acceptable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A pressure switch comprising:

a housing to accommodate a connection terminal having a fixed contact into a center portion of an inside of the housing;

a pressure-receiving chamber communicating with a duct to which an operating pressure is supplied; and a diaphragm assembly having a diaphragm configured to be displaced in response to a pressure inside the pressure-receiving chamber and provided with a movable contact to come into contact with the fixed contact when the pressure inside the pressure-receiving chamber is equal to or above a predetermined value, wherein the movable contact is integrally formed on a center portion of the diaphragm, and wherein at least one of the movable contact formed on the diaphragm and the fixed contact has a plurality of radially diverging contact faces, and wherein at least two or more faces of the radially diverging contact faces formed on one of the movable contact and the fixed contact are positioned to be able to contact an other of the fixed contact and the movable contact at the same time.

2. The pressure switch according to claim 1, wherein a contact face of the movable contact of the diaphragm is formed into an annular shape, and a contact face of the fixed contact is formed substantially into a cross shape.

3. The pressure switch according to claim 1, wherein a contact face of the movable contact of the diaphragm is formed into an annular shape, and a contact face of the fixed contact is formed substantially into a Y-shaped.

4. The pressure switch according to claim 1, wherein a contact face of the movable contact of the diaphragm is formed substantially into a cross shape, and a contact face of the fixed contact is formed into an annular shape.

5. The pressure switch according to claim 1, wherein a contact face of the movable contact of the diaphragm is formed substantially into a Y-shaped, and a contact face of the fixed contact is formed into an annular shape.

* * * * *